US006479440B1

(12) United States Patent
Le Coent

(10) Patent No.: US 6,479,440 B1
(45) Date of Patent: Nov. 12, 2002

(54) ALKALINE EARTH ALKYLARYL SULFONATES, THEIR APPLICATION AS AN ADDITIVE FOR LUBRICATING OIL, AND METHODS OF PREPARATION

(75) Inventor: Jean-Louis Marie Le Coent, Le Havre (FR)

(73) Assignee: Chevron Oronite S. A. (FR)

( * ) Notice: Subject to any disclaimer, the term of this patent is extended or adjusted under 35 U.S.C. 154(b) by 0 days.

(21) Appl. No.: 09/770,927

(22) Filed: Jan. 25, 2001

Related U.S. Application Data

(63) Continuation of application No. PCT/IB00/00916, filed on Jun. 6, 2000.

(30) Foreign Application Priority Data

Jun. 10, 1999 (EP) ..... 99401417

(51) Int. Cl.[7] ..... C10M 159/24; C07C 303/32; C10N 30/04

(52) U.S. Cl. ..... 508/398; 508/391; 508/399

(58) Field of Search ..... 508/390, 391, 508/398, 399

(56) References Cited

U.S. PATENT DOCUMENTS

| | | | | |
|---|---|---|---|---|
| 3,488,722 A | | 1/1970 | Allphin | |
| 4,235,810 A | | 11/1980 | Osselet et al. | |
| 4,764,295 A | * | 8/1988 | Le Coent | 508/390 |
| 5,089,155 A | * | 2/1992 | Marsh et al. | 508/390 |
| 5,112,506 A | * | 5/1992 | Marsh et al. | 508/391 |
| 5,792,732 A | * | 8/1998 | Jao et al. | 508/391 |
| 5,939,594 A | * | 8/1999 | Le Coent | 585/24 |
| 6,054,419 A | * | 4/2000 | Le Coent | 508/391 |
| 6,204,226 B1 | * | 3/2001 | Le Coent et al. | 508/390 |

FOREIGN PATENT DOCUMENTS

| | | | |
|---|---|---|---|
| EP | 0 645 444 A2 | 3/1995 | |
| EP | 0 645 444 A3 | 3/1995 | |
| EP | 0 731 072 B1 | 6/1999 | |
| EP | 0 976 810 A1 | 2/2000 | |
| FR | 2 564 830 | 11/1985 | C07C/143/24 |
| FR | 2 752 838 | 3/1998 | |
| WO | 95 02709 | 1/1995 | |
| WO | 96 10833 | 4/1996 | H01H/11/04 |

* cited by examiner

*Primary Examiner*—Jacqueline V. Howard
(74) *Attorney, Agent, or Firm*—Walter L. Stumpf; Josetta I. Jones

(57) ABSTRACT

An alkaline earth alkylaryl sulfonate having a BN of at least 250, wherein the aryl radical is not phenol, wherein the alkyl chain is a linear chain that contains between 14 and 40 carbon atoms, and wherein the mole % of the aryl-sulfonate radical fixed on position 1 or 2 of the linear alkyl chain is between 13% and 30%. Such an alkaline earth alkylaryl sulfonate has improved compatibility, solubility, and foaming performances while having low color and no skin formation. The starting alkylate has a low iodine number, a very high level of monoalkylate, and, as a consequence, a high yield at the sulfonation step.

14 Claims, No Drawings

ALKALINE EARTH ALKYLARYL SULFONATES, THEIR APPLICATION AS AN ADDITIVE FOR LUBRICATING OIL, AND METHODS OF PREPARATION

This application is a Continuation of International Application No. PCT/IB00/00916, filed Jun. 6, 2000, which claims priority from European Patent Application No. 99 401 417.3 filed on Jun. 10, 1999.

The present invention relates to alkaline earth alkylaryl sulfonates, their application as detergent/dispersant additives for lubricating oils, and methods for preparing those sulfonates.

BACKGROUND OF THE INVENTION

In prior art, methods are known for preparing weakly or strongly superalkalinized sulfonates from sulfonic acids obtained by the sulfonation of different alkyl aryl hydrocarbons and from an excess of alkaline earth base.

The alkyl aryl hydrocarbons subjected to the sulfonation reaction are obtained by alkylation via the Friedel and Craft reaction of different aryl hydrocarbons, particularly aromatic, with two different types of olefin:

Branched olefins obtained by the oligo-polymerization of propylene to $C_{15}$ to $C_{42}$ hydrocarbons, particularly the propylene tetrapolymer dimerized to a $C_{24}$ olefin, and Linear olefins obtained by the oligo-polymerization of ethylene to $C_{14}$ to $C_{40}$ hydrocarbons.

It is easy to obtain a good dispersion in the medium of the alkaline earth base not fixed in the form of salt if the sulfonic acid is derived from a hydrocarbon obtained by alkylation of an aryl hydrocarbon with a branched olefin. It is difficult if the alkylation is effected with a linear olefin. It is particularly difficult for the alkylation of an aryl hydrocarbon where a high percentage of the alkylaryl hydrocarbon has the aryl substituent on positions 1 or 2 of the linear alkyl chain, due to the formation of a skin in the open air.

This poor dispersion is especially pronounced if the medium also contains a high proportion of sulfonate, that is if it corresponds to a low Base Number (between 3 and 60), hence to a low content of free lime and the absence of carbon dioxide and carbonate.

In fact, during the alkylation reaction with benzene or another aromatic or aryl hydrocarbon, 25 mole % of the alkylaryl hydrocarbon has the aryl substituent on positions 1 or 2 of the linear alkyl chain. Traditionally, aromatics attached at the 2-position of the alkyl group give the most absorption of water.

In the alkylation reaction of aromatics using normal alpha olefins (NAO), there are three competing reactions. They are (1) isomerization of the NAO, (2) alkylation of the aromatic with the olefin, and (3) dimerization of the olefin.

When prepared by the method described, for example in French Patent No. 2,564,830, this high proportion of alkyl aryl hydrocarbon having an aryl radical on position 1 or 2 of the linear alkyl chain results in a sulfonate that exhibits hygroscopic properties such that a superficial 'skin' is formed. This 'skin' makes this product unacceptable as an additive for lubricating oil.

Furthermore, the formation of this superficial skin is generally accompanied by a very low filtration rate, a high viscosity, a low incorporation of calcium, a deterioration of anti-rust performance, and an undesirable turbid appearance, or even sedimentation, when the sulfonate thus prepared is added at the rate of 10% by weight to a standard lubricating oil and stored for examination.

The Applicant has carried out chromatographic analysis to identify each of the different isomers differing by the position of the aryl radical on the carbon atom of the linear alkyl chain, and examined their respective influence on the properties of the corresponding alkyl aryl sulfonates of alkaline earth metals obtained from these different isomers.

The Applicant has thus discovered that he could overcome the aforementioned drawbacks, inasmuch as the mole % of the aryl hydrocarbon, other than benzene, having the aryl substituent on positions 1 or 2 of the linear alkyl chain was between 0 and 13%, and preferably between 5 and 11%, and more particularly between 7 and 10%.

This discovery was the subject of a French Patent Application filed Mar. 8, 1995 under No. 95 02,709 by the Applicant.

Yet the Applicant had not succeeded in obtaining satisfactory results when the aryl hydrocarbon was benzene, because, heretofore, he had never been able to prevent the formation of the skin with the use of this aromatic hydrocarbon, even if the hydrocarbon was alkylated with a very long chain linear mono olefin so that the mole % of the aryl hydrocarbon having the aryl substituent on positions 1 or 2 of the linear alkyl chain was between 0 and 13%, and preferably between 5 and 11%, and more particularly between 7 and 10%.

As a result of more intensive studies, the Applicant had discovered that the aforementioned drawbacks could be overcome by using a mixture of alkyl aryl sulfonates of superalkalinized alkaline earth metals comprising:

(a) from 50% to 85% of a linear mono-alkyl phenyl sulfonate in which the linear alkyl chain contains between 14 and 40 carbon atoms, and between 0 and 13 mole % of the phenyl sulfonate radical of the alkaline earth metal is fixed on position 1 or 2 of the linear alkyl chain, and (b) from 15% to 50% of a heavy alkyl aryl sulfonate selected from:

(i) dialkyl aryl sulfonates wherein both alkyl substituents are linear alkyl chains, of which the sum of the carbon atoms is from 16 to 40, or (ii) mono or polyalkyl aryl sulfonates wherein the alkyl substituent or substituents are branched chains, wherein the sum of the carbon atoms is from 15 to 48 carbon atoms.

This mixture of alkyl aryl sulfonates has a maximum of 10 mole % of the phenyl sulfonate radical of the alkaline earth metal fixed on position 1 or 2 of the linear alkyl chain. This mixture has no skin formation after three days of storage in an open jar at room temperature. It has good calcium incorporation, a low viscosity, good solubility, and good performances.

This discovery was the subject of a French Patent Application filed Sep. 5, 1996 under No. 96 10,833 by the Applicant.

As a result of more intensive studies, the Applicant had discovered a mixture of alkyl phenyl sulfonates of alkaline earth metals having low color and no skin formation even after three days of storage in an open jar at room temperature. That mixture comprises:

(a) from 20% to 70% of a linear mono alkyl phenyl sulfonate in which the linear mono alkyl substituent contains from 14 to 40 carbon atoms and the mole % of the phenyl sulfonate radical fixed on position 1 or 2 of the linear alkyl chain is between 10% and 25%, and (b) from 30% to 80% of a branched mono alkyl phenyl sulfonate in which the branched mono alkyl substituent contains from 14 to 18 carbon atoms.

This discovery was the subject of a European Patent Application filed Jul. 31, 1998 under No. 98 401968.9 by the Applicant.

SUMMARY OF THE INVENTION

The present invention provides a highly overbased alkaline earth alkylaryl sulfonate having improved compatibility and solubility, while having low color and no skin formation.

While we have found that a too high concentration of 1-aryl or 2-aryl linear alkylaryl sulfonate causes skin formation in sulfonates, we have found that the higher BN (at least 250 BN) sulfonates are less sensitive to 2-aryl content in the alkylate because the 2-aryl content is diluted by the salts. Therefore, if the BN is high enough (at least 250), and the aryl radical is not phenol, then the mole % of the aryl-sulfonate radical fixed on position 1 or 2 of the linear alkyl chain can be between 13% and 30% (preferably between 15% and 25%) without any skin forming. This high mole percentage of 2-aryl gives a sulfonate having good water absorption properties.

The alkyl chain of that alkaline earth alkylaryl sulfonate is a linear chain that contains between 14 and 40 carbon atoms, preferably from 20 to 24 carbon atoms.

Preferably, the alkaline earth alkylaryl sulfonate has a mono-alkylate content of at least 87% and an Iodine number of less than 1.0.

Preferably, the alkaline earth alkylaryl sulfonate is derived from a $C_4$–$C_{40}$ normal alpha olefin, more preferably from a $C_{20}$–$C_{24}$ normal alpha olefin.

This alkaline earth alkylaryl sulfonate is preferably derived from an alkylate formed by the reaction of benzene and normal alpha olefin in the presence of hydrogen fluoride, preferably in a one-stage reactor. Preferably, the alkylate is formed in the presence of methanol and xylene, but preferably in the absence of chlorine.

Preferably, the alkaline earth alkylaryl sulfonate is used as a detergent/dispersant additive for lubricating oils. A lubricating oil formulation would contain a major amount of a base oil of lubricating viscosity and a minor amount (preferably from 0.5 to 40%) of the alkaline earth alkylaryl sulfonate of the present invention. In addition, the lubricating oil formulation would typically contain from 0 to 20% of at least one ashless dispersant, from 0 to 5% of at least one zinc dithiophosphate, from 0 to 10% of at least one oxidation inhibitor, from 0 to 1% of at least one foam inhibitor; and from 0 to 20% of at least one viscosity index improver.

This lubricating oil composition can be made by blending a major amount of a base oil of lubricating viscosity and from 0.5 to 40% of a detergent comprising the alkaline earth alkylaryl sulfonate of the present invention, preferably with from 0 to 20% of at least one ashless dispersant, from 0 to 5% of at least one zinc dithiophosphate, from 0 to 10% of at least one oxidation inhibitor, from 0 to 1% of at least one foam inhibitor; and from 0 to 20% of at least one viscosity index improver.

A concentrate can be formed comprising from about 10% to 90% of a compatible organic liquid diluent and from about 0.5% to 90% of the alkaline earth alkylaryl sulfonate of the present invention.

BRIEF DESCRIPTION OF THE DRAWINGS

In order to assist the understanding of this invention, reference will now be made to the appended drawings. The drawings are exemplary only, and should not be construed as limiting the invention.

FIG. 1 shows the gel permeation chromatography for Example I of the present invention.

FIG. 2 shows the gel permeation chromatography for Comparative Example A.

FIG. 3 shows the gel permeation chromatography for Comparative Example B.

DETAILED DESCRIPTION OF THE INVENTION

In its broadest aspect, the present invention involves an alkaline earth alkylaryl sulfonate, its application as a detergent/dispersant additive for lubricating oils, and methods for preparing said mixture.

Prior to discussing the invention in further detail, the following terms will be defined:

DEFINITIONS

As used herein the following terms have the following meanings unless expressly stated to the contrary:

The term "alkaline earth metal" refers to calcium, barium, magnesium, and strontium.

The term "alkaline earth alkylaryl sulfonate" refers to an alkaline earth metal salt of an alkylaryl sulfonic acid. In other words, it is an alkaline earth metal salt of an aryl that is substituted with (1) an alkyl group and (2) a sulfonic acid group that is capable of forming a metal salt.

The term "the mole % of the aryl sulfonate radical fixed on position 1 or 2 of the linear alkyl chain" refers to the mole percentage of all the aryl sulfonate radicals fixed on a linear alkyl chain that are fixed at the $1^{st}$ or $2^{nd}$ position of the linear alkyl chain. The $1^{st}$ position of the linear alkyl chain is the position at the end of the chain.

The $2^{nd}$ position of the linear alkyl chain is the position immediately next to the $1^{st}$ position.

The term "1-aryl" refers to an aryl sulfonate radical fixed on a linear alkyl chain at the $1^{st}$ position of the linear alkyl chain.

The term "2-aryl" refers to an aryl sulfonate radical fixed on a linear alkyl chain at the $2^{nd}$ position of the linear alkyl chain.

The term "monoalkylate content" is the weight percentage of the alkylate that is not dialkylate [100×moloalkylate/(moloalkylate+dialkylate)].

The term "Iodine Number" is the absorption value (Hübl Number or Wijs number), which is the quantity of iodine, in grams, absorbed by 100 grams of fat or oil under specified conditions. It indicates the amount of double bonds present.

The term "Base Number" or "BN" refers to the amount of base equivalent to milligrams of KOH in one gram of sample. Thus, higher BN numbers reflect more alkaline products, and therefore a greater alkalinity reserve. The BN of a sample can be determined by ASTM Test No. D2896 or any other equivalent procedure.

The term "overbased alkaline earth alkylaryl sulfonate" refers to a composition comprising a diluent (e.g., lubricating oil) and alkylaryl sulfonate wherein additional alkalinity is provided by a stoichiometric excess of an alkaline earth metal base, based on the amount required to react with the acidic moiety of the detergent. Enough diluent should be incorporated in the overbased detergent to ensure easy handling at safe operating temperatures.

The term "highly overbased alkaline earth alkylaryl sulfonate" refers to an overbased alkaline earth alkylaryl sulfonate having a BN of 250 or more. Generally a carbon dioxide treatment is required to obtain high BN overbased detergent compositions. It is believed that this forms a colloidal dispersion of metal base.

Unless otherwise specified, all percentages are in weight percent, all ratios are molar ratios, and all molecular weights are number average molecular weights.

ALKYLARYL SULFONATES

The alkylaryl sulfonates of the present invention are highly overbased alkaline earth alkylaryl sulfonates having linear alkyl groups, and having a high mole % of the aryl-20 sulfonate radical fixed on position 1 or 2 of the linear alkyl chain (13% to 30%, preferably 15% to 25%.). These alkylaryl sulfonates have improved compatibility and solubility, while having low color and no skin formation.

It is essential that the alkylaryl sulfonates be highly overbased (BN of at least 250), in order to diluent the 2-aryl content sufficiently so that skin formation will not result.

It is also essential that the aryl radical is not phenol, since highly overbased alkylphenoxy sulfonates having a high 2-aryl content tend to be too viscous for easy handling. Preferably, it is an alkyl benzene sulfonate or an alkyl toluene sulfonate.

The linear alkyl chain contains between 14 and 40 carbon atoms, preferably from 20 to 24 carbon atoms. Preferably, the alkaline earth alkylaryl sulfonate is derived from a $C_4$–$C_{40}$ normal alpha olefin, more preferably from a $C_{20}$–$C_{24}$ normal alpha olefin.

Preferably, the alkaline earth alkylaryl sulfonate has a monoalkylate content of at least 87% and an Iodine number of less than 1.0.

French Patent No. 2.564.830 to the company Orogil, the former name of the Assignee, and whose corresponding application was published in 1985, and which corresponds to U.S. Pat. No. 4,764,295 describes alkylaryl sulfonates of alkaline earth metals resulting from alkylation by a linear olefin.

The alkaline earth alkylaryl sulfonate can derived from an alkylate formed by the reaction of benzene and normal alpha olefin in the presence of hydrogen fluoride, preferably in a one-stage reactor. Preferably, the alkaline earth alkylaryl sulfonate is formed in the presence of methanol and xylene, and in the absence of chlorine.

Preferably, the alkaline earth alkylaryl sulfonate is used in conjunction with another detergent, preferably a sulfurized alkaline earth alkylaryl phenate.

OTHER ADDITIVE COMPONENTS

The following additive components are examples of components that can be favorably employed in combination with the mixture of alkyl aryl sulfonates of alkaline earth metals in the compositions of the present invention:

(1) Ashless dispersants: alkenyl succinimides, alkenyl succinimides modified with other organic compounds, and alkenyl succinimides modified with boric acid, alkenyl succinic ester.

(2) Detergents: sulfurized or unsulfurized alkyl or alkenyl phenates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl salicylates, sulfurized or unsulfurized alkyl or alkenyl naphthenates, metal salts of alkanoic acids, metal salts of an alkyl or alkenyl multiacid, and chemical and physical mixtures thereof.

(3) Oxidation inhibitors:

1) Phenol type phenolic) oxidation inhibitors: 4,4'-methylenebis (2,6-di-tert-butylphenol), 4,4'-bis(2,6-di-tert-butylphenol), 4,4'-bis(2-methyl-6-tert-butylphenol), 2,2'-(methylenebis(4-methyl-6-tert-butyl-phenol), 4,4'-butylidenebis(3-methyl4-tert-butylphenol), 4,4'-isopropylidenebis(2,6-di-tert-butyl phenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl4-methylphenol, 2,6-di-tert-butyl-4-ethylphenol, 2,4-dimethyl-6-tert-butyl-phenol, 2,6-di-tert-a-dimethylamino-p-cresol, 2,6-di-tert4-(N,N'dimethylaminomethylphenol), 4,4'-thiobis(2-methyl-6-tert-butylphenol), 2,2'-thiobis(4-methyl-6-tert-butylphenol), bis(3-methyl4-hydroxy-5-tert-butylbenzyl)-sulfide, and bis(3,5-di-tert-butyl4-hydroxybenzyl).

2) Diphenylamine type oxidation inhibitor: alkylated diphenylamine, phenyl-α-naphthylamine, and alkylated a-naphthylamine.

3) Other types: metal dithiocarbamate (e.g., zinc dithiocarbamate), and methylenebis (dibutyldithiocarbamate).

(4) Rust inhibitors (Anti-rust agents):

1) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.

2) Other compounds: stearic acid and other fatty acids, dicarboxilic acids, metal soaps, fatty acid amine salts, metal salts of heavy sulfonic acid, partial carboxylic acid ester of polyhydric alcohol, and phosphoric ester.

(5) Demulsifiers: addition product of alkylphenol and ethyleneoxide, poloxyethylene alkyl ether, and polyoxyethylene sorbitane ester.

(6) Extreme pressure agents (EP agents): zinc dialkyldithiophosphate (Zn-DTP, primary alkyl type & secondary alkyl type), sulfurized oils, diphenyl sulfide, methyl trichlorostearate, chlorinated naphthalene, benzyl iodide, fluoroalkylpolysiloxane, and lead naphthenate.

(7) Friction modifiers: fatty alcohol, fatty acid, amine, borated ester, and other esters (8) Multifunctional additives: sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenum complex compound (9) Viscosity index improvers: polymethacrylate type polymers, ethylene-propylene copolymers, styrene-isoprene copolymers, hydrated styrene-isoprene copolymers, polyisobutylene, and dispersant type viscosity index improvers.

(10) Pour point depressants: polymethyl methacrylate.

(11) Foam Inhibitors: alkyl methacrylate polymers and dimethyl silicone polymers.

OIL OF LUBRICATING VISCOSITY

The oil of lubricating viscosity used in such compositions may be mineral oil or synthetic oils of viscosity suitable for use in the crankcase of an internal combustion engine, such as gasoline engines and diesel engines, including passenger car, heavy duty on-road and off-road, railroad, natural gas and marine, such as trunk piston and slow speed crosshead engines. Crankcase lubricating oils ordinarily have a viscosity of about 1300 cSt at 0° F. (−18° C.) to 24 cSt at 210° F. (99° C.). The lubricating oils may be derived from synthetic or natural sources. Mineral oil for use as the base oil in this invention includes paraffinic, naphthenic, and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins, such as 1-decene trimer. Likewise, alkyl benzenes of proper viscosity, such as didodecyl benzene, can be used. Useful synthetic esters include the esters of both monocarboxylic acids and polycarboxylic acids, as well as monohydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used.

Blends of mineral oils with synthetic oils are also useful. For example, blends of 10% to 25% hydrogenated 1-decene trimer with 75% to 90% 150 SUS (100° F.) mineral oil gives an excellent lubricating oil base.

LUBRICATING OIL COMPOSITIONS

The additives produced by the process of this invention are useful for imparting detergency and dispersancy properties to the lubricating oil. When employed in this manner, the amount of alkaline earth alkylaryl sulfonate ranges from about 0.5% to 40% of the total lubricant composition, preferably from about 1% to 25% of the total lubricant composition. Such lubricating oil compositions are useful in the crankcase of an internal combustion engine, such as gasoline engines and diesel engines, including passenger car, heavy duty on-road and off-road, railroad, natural gas and marine, such as trunk piston and slow speed crosshead engines. They are also useful in hydraulic applications.

The lubricating oil composition can be used in a method of decreasing black sludge deposits, a method of decreasing piston deposits, or both.

Such lubricating oil compositions employ a finished lubricating oil, which may be single or multigrade. Multigrade lubricating oils are prepared by adding viscosity index (VI) improvers. Typical VI improvers are polyalkyl methacrylates, ethylene-propylene copolymers, styrene-diene copolymers, and the like. So-called dispersant VI improvers, which exhibit dispersant properties as well as VI modifying properties, can also be used in such formulations.

In one embodiment, a lubricating oil composition would contain (a) a major amount of an oil of lubricating viscosity;

(b) from 0.5% to 40% of a detergent comprising the alkaline earth alkylaryl sulfonate of the present invention;

(c) from 0% to 20% of at least one ashless dispersant;

(d) from 0% to 5% of at least one zinc dithiophosphate;

(e) from 0% to 10% of at least one oxidation inhibitor;

(f) from 0% to 1% of at least one foam inhibitor; and (g) from 0% to 20% of at least one viscosity index improver.

PROCESS FOR PRODUCING A LUBRICATING OIL COMPOSITION

In one embodiment, a lubricating oil composition is produced by blending a mixture of:

(a) a major amount of an oil of lubricating viscosity;

(b) from 0.5% to 40% of a detergent comprising the alkaline earth alkylaryl sulfonate of the present invention, preferably also comprising a sulfurized alkylaryl phenate;

(c) from 0% to 20% of at least one ashless dispersant;

(d) from 0% to 5% of at least one zinc dithiophosphate;

(e) from 0% to 10% of at least one oxidation inhibitor;

(f) from 0% to 1% of at least one foam inhibitor; and (g) from 0% to 20% of at least one viscosity index improver.

The lubricating oil composition produced by that method might have a slightly different composition than the initial mixture, because the components may interact. The components can be blended in any order and can be blended as combinations of components.

ADDITIVE CONCENTRATES

Additive concentrates are also included within the scope of this invention. The concentrates of this invention comprise the alkaline earth alkylaryl sulfonate of the present invention, with at least one of the additives disclosed above. Typically, the concentrates contain sufficient organic diluent to make them easy to handle during shipping and storage.

From 10% to 90% of the concentrate is organic diluent. From 0.5% to 90% of concentrate is the mixture of alkyl aryl sulfonates of alkaline earth metals of the present invention. The remainder of the concentrate consists of other additives.

Suitable organic diluents which can be used include for example, solvent refined 100N, i.e., Cit-Con 100N, and hydrotreated 100N, i.e., RLOP 100N, and the like. The organic diluent preferably has a viscosity of from about 1 to about 20 cSt at 100° C.

EXAMPLES OF ADDITIVE PACKAGES

Below are representative examples of additive packages that can be used in a variety of applications. These representative examples employ the novel dispersants of the present invention. The following percentages are based on the amount of active component, with neither process oil nor diluent oil. These examples are provided to illustrate the present invention, but they are not intended to limit it.

The detergent cited below can be either the alkaline earth alkylaryl sulfonate of the present invention alone or in combination with another detergent.

I. MARINE DIESEL ENGINE OILS

| | | |
|---|---|---|
| 1) | Detergent | 65% |
| | Primary alkyl Zn-DTP | 5% |
| | Oil of lubricating viscosity | 30% |
| 2) | Detergent | 65% |
| | Alkenyl succinimide ashless dispersant | 5% |
| | Oil of lubricating viscosity | 30% |
| 3) | Detergent | 60% |
| | Primary alkyl Zn-DTP | 5% |
| | Alkenyl succinimide ashless dispersant | 5% |
| | Oil of lubricating viscosity | 30% |

-continued

| | | |
|---|---|---|
| 4) | Detergent | 65% |
| | Phenol type oxidation inhibitor | 10% |
| | Oil of lubricating viscosity | 25% |
| 5) | Detergent | 55% |
| | Alkylated diphenylamine-type oxidation inhibitor | 15% |
| | Oil of lubricating viscosity | 30% |
| 6) | Detergent | 65% |
| | Phenol-type oxidation inhibitor | 5% |
| | Alkylated diphenylamine-type oxidation inhibitor | 5% |
| | Oil of lubricating viscosity | 25% |
| 7) | Detergent | 60% |
| | Primary alkyl Zn-DTP | 5% |
| | Phenol-type oxidation inhibitor | 5% |
| | Oil of lubricating viscosity | 30% |
| 8) | Detergent | 60% |
| | Alkenyl succinimide ashless dispersant | 5% |
| | Alkylated diphenylamine-type oxidation inhibitor | 10% |
| | Oil of lubricating viscosity | 25% |
| 9) | Detergent | 55% |
| | Other additives | 25% |
| | Primary alkyl Zn-DTP | |
| | Alkenyl succinic ester ashless dispersant | |
| | Phenol-type oxidation inhibitor | |
| | Alkylated diphenylamine-type oxidation inhibitor | |
| | Oil of lubricating viscosity | 30% |

II. MOTOR CAR ENGINE OILS

| | | |
|---|---|---|
| 1) | Detergent | 25% |
| | Alkenyl succinimide ashless dispersant | 35% |
| | Primary alkyl Zn-DTP | 10% |
| | Oil of lubricating viscosity | 30% |
| 2) | Detergent | 20% |
| | Alkenyl succinimide ashless dispersant | 40% |
| | Secondary alkyl Zn-DTP | 5% |
| | Dithiocarbamate type oxidation inhibitor | 5% |
| | Oil of lubricating viscosity | 30% |
| 3) | Detergent | 20% |
| | Alkenyl succinimide ashless dispersant | 35% |
| | Secondary alkyl Zn-DTP | 5% |
| | Phenol type oxidation inhibitor | 5% |
| | Oil of lubricating viscosity | 35% |
| 4) | Detergent | 20% |
| | Alkenyl succinimide ashless dispersant | 30% |
| | Secondary alkyl Zn-DTP | 5% |
| | Dithiocarbamate type anti-wear agent | 5% |
| | Oil of lubricating viscosity | 40% |
| 5) | Detergent | 20% |
| | Succinimide ashless dispersant | 30% |
| | Secondary alkyl Zn-DTP | 5% |
| | Molybdenum-containing anti-wear agent | 5% |
| | Oil of lubricating viscosity | 40% |
| 6) | Detergent | 20% |
| | Alkenyl succinimide ashless dispersant | 30% |
| | Other additives | 10% |
| | Primary alkyl Zn-DTP | |
| | Secondary alkyl Zn-DTP | |
| | Alkylated diphenylamine-type oxidation inhibitor | |
| | Dithiocarbamate type anti-wear agent | |
| | Oil of lubricating viscosity | 40% |
| 7) | Detergent | 60% |
| | Other additives | 10% |
| | Phenol type oxidation inhibitor | |
| | Alkylated diphenylamine-type oxidation inhibitor | |
| | Dithiocarbamate type anti-wear agent | |
| | Demulsifier | |
| | Boron-containing friction modifier | |
| | Oil of lubricating viscosity | 30% |

III. HYDRAULIC OILS

| | | |
|---|---|---|
| 1) | Detergent | 20% |
| | Primary alkyl Zn-DTP | 50% |
| | Other additives | 25% |
| | Phenol type oxidation inhibitor | |
| | Phosphorous-containing extreme pressure agent | |
| | Triazol type corrosion inhibitor | |
| | Demulsifier | |
| | Nonionic anti-rust agent | |
| | Oil of lubricating viscosity | 5% |
| 2) | Detergent | 10% |
| | Primary alkyl Zn-DTP | 40% |
| | Other additives | 47% |
| | Phenol type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 3% |
| 3) | Detergent | 10% |
| | Phosphorous-containing extreme pressure agent | 40% |
| | Phenol type oxidation inhibitor | 15% |
| | Other additives | 25% |
| | Diphenylamine type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 10% |
| 4) | Detergent | 20% |
| | Phosphorous-containing extreme pressure agent | 30% |
| | Other additives | 45% |
| | Diphenylamine type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 5% |

IV. TRANSMISSION HYDRAULIC FLUIDS

| | | |
|---|---|---|
| 1) | Detergent | 35% |
| | Primary alkyl Zn-DTP | 20% |
| | Polyol type friction modifier | 20% |
| | Sulfur-containing extreme pressure agent | 5% |
| | Oil of lubricating viscosity | 20% |
| 2) | Detergent | 40% |
| | Primary alkyl Zn-DTP | 15% |
| | Amide type friction modifier | 15% |
| | Sulfur-containing extreme pressure agent | 5% |
| | Oil of lubricating viscosity | 25% |
| 3) | Detergent | 30% |
| | Primary alkyl Zn-DTP | 20% |
| | Other additives | 30% |
| | Alkenyl succinimide ashless dispersant | |
| | Amide type friction modifier | |
| | Ester type friction modifier | |
| | Phosphorous, sulfur-containing extreme pressure agent | |
| | Oil of lubricating viscosity | 20% |
| 4) | Detergent | 35% |
| | Primary alkyl Zn-DTP | 15% |
| | Other additives | 25% |
| | Polyol type friction modifier | |
| | Amide type friction modifier | |
| | Phosphorous, sulfur-containing extreme pressure agent | |
| | Oil of lubricating viscosity | 25% |

EXAMPLES

The invention will be further illustrated by following examples, which set forth particularly advantageous method embodiments. While the Examples are provided to illustrate the present invention, they are not intended to limit it.

METHODS OF MEASUREMENTS

The examples contain test results obtained by the following methods of measurements:

Viscosity at 100° C. in cSt

The viscosity was measured at the temperature of 100° C. after dilution of the product sample to be measured in 600 N oil, until a solution was obtained having a total calcium content of 15.5%. The viscosity was measured following method ASTM D 445.

Compatibility

Two methods were used to evaluate the appearance and the storage stability of the additives and the corresponding oils containing them. These methods are applicable to additives for lubricants.

Method No. 1: Accelerated Stability Storage Test (ASST)

Procedure:

Form a blend of 100 grams in a beaker of 250 ml of the following products:

A 250 BN phenate in a quantity such that the BN coming from the phenate in blend of 100 grams is 35.

A 400 BN sulfonate (or a 320 BN sulfonate) in a quantity such that the BN coming from the sulfonate in the blend of 100 grams is 35.

35 grams of diluent oil named 150 bright stock (from ldemitsu Kosan Company).

Complete to 100 grams by adding a 500N diluent oil (from Idemitsu Kosan Company).

Blend during 30 minutes at 65° C., then put the oil obtained into a centrifuge tube. Keep it in an oven during 24 hours at 100° C. then centrifuge during one hour at 4540 rpm.

Read the sediment content. If the sediment content is less than 0.05% the oil the results are a <<pass>>, otherwise it is a <<fail>>.

Method No. 2: Compatibility/solubility in a severe base oil having the following composition:

20% bright stock (from ldemitsu Kosan Company).

80% 500 N (from Idemitsu Kosan Company). Procedure:

Add to the severe base oil a quantity of 400 BN HOB Sulfonates in order to obtain a solution having 100 m moles calcium per liter.

Mix the base oil and sulfonates under agitation for thirty minutes at a temperature of 80° C.

Divide the oil into two bottles, one kept at room temperature and the other kept at a temperature of 80° C.

Evaluate the blend right after blending using a foam test (ASTM D 892).

Evaluate the appearance each week.

Color Test

A color test (ASTM D1500) was performed on the sulfonate prior to blending.

PROCEDURES FOR PREPARATION

Synthesis of the Alkylate

The alkylate was synthesized in an alkylation pilot plant with hydrofluoric acid, which consists of two reactors in series of 1.150 liters each, and a 25 liter settler wherein the organic phase was separated from the phase containing the hydrofluoric acid, all of the equipment being maintained under a pressure of about $5\times10^5$ Pa.

The organic phase was then withdrawn via a valve, and expanded to atmospheric pressure, and the benzene was removed by topping, that means by heating to 160° C. at atmospheric pressure.

After withdrawal, the mineral phase was neutralized by caustic potash.

The reaction was carried out in either one or two reactors:

If only one reactor was used, the benzene/olefin mole ratio was 10:1, which was very high, and the second reactor was by-passed.

If two reactors were used, the benzene/olefin mole ratio was relatively low in the first reactor, about 1:1 to 1.5:1, and it was higher in the second reactor, about 2:1 to 10:1. Furthermore, the ratio of hydrofluoric acid to the olefin by volume was about 1:1 in the first reactor and about 2:1 in the second reactor.

Distillation of the Alkylate

As benzene was alkylated by a $C_{20}$ to $C_{24}$ linear olefin, there was no formation of a light fraction. Hence it was sufficient to effect a topping of the unreacted benzene and residual hydrofluoric acid to obtain the corresponding alkylate.

Sulfonation of the Alkylate

The molar proportion of the phenyl radical substituted on the carbon atoms in position 1 or 2 of the alkyl radical was determined on the alkylate, then the alkylate was subjected to the sulfonation reaction.

Sulfonation was conducted on the alkylate using sulfur trioxide ($SO_3$), produced by the passage of a mixture of oxygen and sulfur dioxide ($SO_2$) through a catalytic furnace containing vanadium oxide ($V_2O_5$). The sulfur trioxide gas was introduced at the top of a sulfonation reactor (2 meter long and 1 cm in diameter) in a concurrent alkylate stream.

The resulting sulfonic acid was recovered at the bottom of the reactor. The sulfonation conditions are as follows:

The $SO_3$ flow rate was set at 76 grams/hour.

The alkylates flow rate was between 300 and 450 grams/hour, depending on the desired $SO_3$:alkylate mole ratio, which varied from 0.8:1 to 1.2:1.

The sulfonation temperature was between 50° and 60° C.

Nitrogen was used as vector gas to dilute the $SO_3$ to 4% by volume.

After the sulfonation reaction, the residual sulfuric acid was removed by thermal treatment after dilution by 10% 100 N oil, nitrogen bubbling at the rate of 10 liter/hour per Kg of product, and stirring at 85° C., until a lower residual $H_2SO_4$ content was obtained (maximum 0.5% by weight).

Superalkalinization

In this step, hydrated lime $Ca(OH)_2$ was added to the reaction product at a very high molar ratio of hydrated lime versus sulfonic acid, and the product was reacted in order to obtain a final product having a BN higher than 250 (preferably between 300 and 430) according to standard ASTM D 2896.

To obtain this, a quantity of $Ca(OH)_2$ was added in large excess to the stoichiometric neutralization of the quantity of sulfonic acid reacted (0.5 mole of $Ca(OH)_2$ per mole of this sulfonic acid).

The lime reagent was methanol and the solvent was xylene. The carbonation was carried out by $CO_2$ at a temperature between 20° and 55° C. Before elimination of the solvent, the sediment was eliminated by centrifugation.

The performance obtained by the alkyl aryl sulfonate mixtures of the invention are summarized in the table given at the end of the present specification.

EXAMPLE 1

The product of the present invention was produced in one continuous reactor with hydrofluoric acid. The molar ratio of benzene:olefin was 10:1.

COMPARATIVE EXAMPLE A

A comparative product was produced in two staged batch reactors with hydrofluoric acid. The molar ratio of benzene:olefin was 1.2:1 in the first reactor, and 5.8:1 in the second reactor.

COMPARATIVE EXAMPLE B

A comparative product was produced in one batch reactor with $AlCl_3$. The molar ratio of benzene:olefin was 10:1.

In each of the above examples (I, A, and B), the aromatic was benzene, the olefin was a linear $C_{20}$–$C_{24}$ olefin, and the conditions for obtaining alkylate are benzene topping.

GEL PERMEATION CHROMATOGRAPHY RESULTS

These three products were analyzed through a gel permeation chromatography, as shown in FIGS. 1, 2, and 3. Three peaks appeared:

The smallest molecule (monoalkylate $C_{20}$–$C_{24}$) has the longest retention time. The biggest molecule has the shortest retention time.

In Example 1, the product was predominantly monoalkylate (retention time=13.2 minutes).

In Comparative Example A, there was a higher level of dimerization during alkylation (smaller excess of benzene in the first reactor), a light increase of heavy peak 2 (retention time=12.2 min.) and the appearance of a third peak (still heavier at 11.7 min).

In Comparative Example B, there was a significant decrease of percentage of mono-alkylate and a significant increase in the third peak.

| | Example I | Comparative Example A | Comparative Example B |
|---|---|---|---|
| Peak 1 (Mono-alkylate) | 92 | 85.6 | 74 |
| Peak 2 (Heavy) | 8 | 8.9 | 12.5 |
| Peak 3 (Heavy) | | 5.5 | 13.5 |
| Sulfonation | | | |
| % $HSO_3^-$ | 15.8 | 15.1 | 14.3 |
| % $H_2SO_4$ | 0.2 | 0.2 | 0.2 |

Thus, Example I had the lowest level of heavy (dimer+dialkylate material). As a consequence, the level of sulfonation was the highest (causing a major improvement in the conversion at the sulfonation step).

| | Example I | Comparative Example A | Comparative Example B |
|---|---|---|---|
| Alkylation Conditions | | | |
| Alkylation Catalyst | HF | HF | $AlCl_3$ |
| Reactor 1: Aromatic:Olefin | 10:1 | 1.2:1 | 10:1 |
| Reactor 2: Total aromatic:olefin | | 5.8:1 | |
| Analysis of Alkylate | | | |
| Position 1 + 2 Σpositions | 0.20 | 0.10 | 0.209 |
| Viscosity at 40° C. (cSt) | 18 | 17.8 | 19 |
| Iodine index (grams/100 grams) | 0.6 | 1.1 | 0.6 |
| Analysis of the Acid | | | |
| % $HSO_3^-$(weight) | 15.8 | 15.1 | 14.3 |
| % $H_2SO_4$ (weight) | 0.2 | 0.2 | 0.2 |
| Analysis of the Sulfonate | | | |
| % Ca (Total) | 15.8 | 15.8 | 15.8 |
| BN ASTM D 2896 | 418 | 418 | 418 |
| Viscosity at 100° C. (cSt) | 118 | 92 | 112 |

-continued

| | Example I | Comparative Example A | Comparative Example B |
|---|---|---|---|
| Compatibility | | | |
| Method 1 | << pass >> | << fail >> | << fail >> |
| Method 2 - 1 week | << pass >> | << pass >> | << fail >> |
| Method 2 - 2 weeks | << pass >> | << fail >> | << fail >> |
| Method 2 - 3 weeks | << pass >> | << fail >> | << fail >> |
| Method 2 - 4 weeks | << pass >> | << fail >> | << fail >> |
| Foaming (Sequence I) ASTM D892 | 0/0 | 20/0 | 30/0 |
| Color (ASTM D1500) | 5.8D | 6.2D | 5.8D |

While the present invention has been described with reference to specific embodiments, this application is intended to cover those various changes and substitutions that may be made by those skilled in the art without departing from the spirit and scope of the appended claims.

What is claimed is:

1. An alkaline earth alkylaryl sulfonate having, a BN of at least 250, where the aryl radical is other than phenol, wherein the alkyl chain is a linear chain that contains between 14 and 40 carbon atoms and wherein the mole % of the aryl sulfonate radical fixed on position 1 or 2 of the linear alkyl chain is between 13% and 30%.

2. An alkaline earth alkylaryl sulfonate as in claim 1 wherein said alkaline earth alkylaryl sulfonate has a monoalkylate content of at least 87% and an iodine number of less than 1.0.

3. An alkaline earth alkylaryl sulfonate as in claim 1 wherein the alkyl chain is derived from a $C_4$–$C_{40}$ normal alpha olefin.

4. An alkaline earth alkylaryl sulfonate as in claim 1 wherein the alkylaryl sulfonate is derived from an alkylate formed by the reaction of benzene and normal alpha olefin in the presence of hydrogen fluoride, preferably in a one-stage reactor.

5. An alkaline earth alkylaryl sulfonate as in claim 4 wherein the sulfonate is formed in the presence of methanol and xylene.

6. An alkaline earth alkylaryl sulfonate as in claim 4 wherein the sulfonate is formed in the absence of chlorine.

7. A detergent/dispersant additive for lubricating oils having improved solubility in severe base oils and having improved compatibility with phenates in severe base oils and having improved foaming performances, said detergent/dispersant additive comprising the alkaline earth alkylaryl sulfonate as in one of claims 1–6.

8. A lubricating oil formulation containing the alkaline earth alkylaryl sulfonate as in one of claims 1–6.

9. A lubricating oil formulation comprising:

(a) a major amount of a base oil of lubricating viscosity;

(b) from 0.5 to 40% of a detergent comprising the alkaline earth alkylaryl sulfonate as in one of claims 1–6;

(c) from 0 to 20% of at least one ashless dispersant;

(d) from 0 to 5% of at least one zinc dithiophosphate;

(e) from 0 to 10% of at least one oxidation inhibitor;

(f) from 0 to 1% of at least one foam inhibitor; and (g) from 0 to 20% of at least one viscosity index improver.

10. A method of producing a lubricating oil composition comprising blending the following components together:

(a) a major amount of a base oil of lubricating viscosity;

(b) from 0.5% to 40% of a detergent comprising the alkaline earth alkylaryl sulfonate as in one of claims 1–6;

(c) from 0 to 20% of at least one ashless dispersant;

(d) from 0 to 5% of at least one zinc dithiophosphate;

(e) from 0 to 10% of at least one oxidation inhibitor;

(f) from 0 to 1% of at least one foam inhibitor; and (g) from 0 to 20% of at least one viscosity index improver.

11. A lubricating oil composition produced by the method according to claim 10.

12. A concentrate comprising from about 10 weight % to 90 weight % of a compatible organic liquid diluent and from about 0.5 weight % to 90 weight % of the alkaline earth alkylaryl sulfonate as in one of claims 1–6.

13. An alkaline earth alkylaryl sulfonate as in claim 1 wherein the alkyl chain is a linear chain that contains from 20 to 24 carbon atoms.

14. An alkaline earth alkylaryl sulfonate as in claim 1 wherein the mole % of the aryl sulfonate radical fixed on position 1 or 2 of the linear alkyl chain is between 15% and 25%.

* * * * *